US011039664B2

(12) United States Patent
Huneau et al.

(10) Patent No.: US 11,039,664 B2
(45) Date of Patent: Jun. 22, 2021

(54) SKATE WITH REMOVABLE TONGUE

(71) Applicant: SPORT MASKA INC., Montreal (CA)

(72) Inventors: Alexandre Huneau, Laval (CA); Etienne Champagne, Saint-Joseph-de-Beauce (CA); Georges-Emmanuel Harvey, Laval (CA); Daniel Chartrand, Lorraine (CA)

(73) Assignee: SPORT MASKA INC., Montreal (CA)

( * ) Notice: Subject to any disclaimer, the term of this patent is extended or adjusted under 35 U.S.C. 154(b) by 39 days.

(21) Appl. No.: 15/666,767

(22) Filed: Aug. 2, 2017

(65) Prior Publication Data

US 2019/0037963 A1 Feb. 7, 2019

(51) Int. Cl.
*A43B 23/26* (2006.01)
*A43B 5/16* (2006.01)

(52) U.S. Cl.
CPC ..... *A43B 23/26* (2013.01); *A43B 5/1666* (2013.01)

(58) Field of Classification Search
CPC ..... A43B 5/1666; A43B 5/0405; A43B 23/26; A43C 11/02; A43C 11/04; A43C 11/20; Y10T 24/44026; Y10T 24/44077
USPC ..... 36/54
See application file for complete search history.

(56) References Cited

U.S. PATENT DOCUMENTS 601,192 A 3/1898 Woodside
623,350 A 4/1899 Blanc
1,253,777 A 1/1918 Bromley
1,348,703 A * 8/1920 Ferris ..... A43C 11/04 24/575.1
1,570,625 A * 1/1926 Eddins ..... A41F 11/02 24/524
1,897,261 A * 2/1933 Killory ..... A41F 5/00 2/117
2,022,554 A * 11/1935 Williams ..... A43B 23/26 24/712.3
2,093,231 A * 9/1937 Broadwell ..... A41F 11/04 24/464
2,887,795 A * 5/1959 Taicher ..... A43C 11/24 36/1

(Continued)

FOREIGN PATENT DOCUMENTS

CA 2071806 7/1993
WO 2007126991 11/2007

OTHER PUBLICATIONS

International Search Report dated Sep. 14, 2018 in corresponding application PCT/CA2018/050946.

*Primary Examiner* — Heather Mangine
(74) *Attorney, Agent, or Firm* — Norton Rose Fulbright Canada

(57) ABSTRACT

A skate includes a boot having a toe portion with a toe portion connector on at least one of its inner and outer surfaces. A tongue is mountable within the boot of the skate. The tongue at its lower end has a pressing member with cooperating first and second segments. The tongue has a tongue connector on at least one of the first and second segments. At least one of the first and second segments is foldable to engage the first segment with the inner surface of the toe portion and the second segment with the outer surface of the toe portion, and to engage the tongue connector with the toe portion connector to removably connect the tongue to the toe portion.

8 Claims, 5 Drawing Sheets

(56) References Cited

U.S. PATENT DOCUMENTS 3,059,359 A * 10/1962 Goldammer ..... G09F 3/005 40/633
3,334,427 A * 8/1967 Edwards ..... A43C 13/14 36/72 R
3,346,927 A * 10/1967 Tompkins ..... A47K 10/12 24/464
3,491,416 A * 1/1970 Fenwick ..... A41F 11/04 24/464
3,508,303 A * 4/1970 Tetzuo ..... B65D 33/06 24/298
3,822,489 A * 7/1974 Johnson ..... A43B 23/26 36/100
3,841,004 A * 10/1974 Gray ..... A43C 13/10 36/72 R
3,995,382 A * 12/1976 Smith ..... A43B 23/082 36/72 R
4,126,951 A * 11/1978 Antonious ..... A43B 1/0081 24/306
4,221,063 A * 9/1980 Charles ..... G09F 3/005 283/75
4,351,537 A * 9/1982 Seidel ..... A43B 5/1616 280/11.12
4,458,429 A 7/1984 Schmid
4,507,880 A 4/1985 Ohashi
4,509,276 A * 4/1985 Bourque ..... A43B 5/1683 36/115
4,583,306 A * 4/1986 Paris ..... A43B 5/0449 36/117.9
4,805,321 A * 2/1989 Tonkel ..... A43B 3/0031 36/100
4,839,971 A * 6/1989 Reber ..... A43B 23/087 36/72 R
4,920,666 A * 5/1990 Marega ..... A43B 1/0018 36/10
4,996,752 A * 3/1991 Clendinen ..... F16B 21/06 24/464
5,075,938 A * 12/1991 Hutchinson ..... A44B 17/0029 24/108
5,171,033 A * 12/1992 Olson ..... A43B 5/1675 280/11.202
5,174,050 A * 12/1992 Gabrielli ..... A43B 5/0405 36/10
5,214,806 A * 6/1993 Flores ..... A41B 13/00 2/300
5,226,809 A * 7/1993 Franco ..... A44B 17/0029 24/662
5,265,353 A * 11/1993 Marega ..... A43B 5/0405 36/117.6
5,313,721 A * 5/1994 Filden ..... A44C 3/001 24/458
5,357,695 A * 10/1994 Lu ..... A43B 5/1633 36/115
5,365,677 A 11/1994 Dahlgren
5,448,846 A * 9/1995 Peterson ..... G09F 3/005 24/484
5,459,947 A * 10/1995 Lasher ..... A43B 23/26 24/306
5,511,323 A 4/1996 Dahlgren
5,553,402 A * 9/1996 Marega ..... A43B 5/0409 36/117.7
D375,618 S 11/1996 Chen
5,647,146 A * 7/1997 Gabrielli ..... A43B 5/0405 36/10
5,659,979 A * 8/1997 Sileo ..... A43B 1/0072 206/223
5,671,517 A * 9/1997 Gourley ..... A43B 3/0078 24/306
5,678,833 A 10/1997 Olson et al.
5,746,016 A * 5/1998 Freisinger ..... A43B 5/0472 36/117.1
5,826,312 A * 10/1998 Schroder ..... B60N 2/5825 24/601.2
6,082,028 A 7/2000 Demarchi
6,128,837 A 10/2000 Huang
6,321,466 B1 * 11/2001 Bordin ..... A43B 5/0405 24/68 R
6,360,454 B1 * 3/2002 Dachgruber ..... A43B 5/0401 36/117.1
6,381,877 B2 5/2002 Filice
6,401,364 B1 6/2002 Burt
6,431,585 B1 * 8/2002 Rickabus ..... B60R 21/215 24/114.05
D468,521 S 1/2003 Wilson
6,895,696 B1 * 5/2005 Sanders ..... A43B 3/0031 24/712.1
7,137,216 B2 * 11/2006 Ali ..... G09F 3/005 40/633
7,165,342 B2 * 1/2007 Sheen ..... A41D 13/06 36/114
7,257,906 B2 8/2007 Jones et al.
7,290,355 B2 11/2007 Labonte
7,318,290 B2 * 1/2008 Jones ..... A43B 1/0027 36/100
7,325,813 B2 2/2008 Bock
7,451,991 B2 11/2008 Labonte
7,523,567 B1 4/2009 McClelland
7,685,739 B2 * 3/2010 Aveni ..... A43B 3/24 36/100
8,161,664 B1 * 4/2012 Dawson ..... A43B 1/0054 36/54
8,181,366 B2 * 5/2012 Sartor ..... A43B 5/0458 36/117.1
8,359,769 B2 1/2013 Vattes et al.
8,375,522 B2 * 2/2013 York ..... G09F 3/005 24/16 PB
8,381,419 B2 * 2/2013 Fenato ..... A43B 5/0411 36/117.4
8,387,286 B2 3/2013 Koyess et al.
8,813,393 B2 8/2014 Koyess et al.
9,119,441 B2 * 9/2015 Frappier ..... A43B 5/1675
9,320,315 B2 * 4/2016 Van Horne ..... A43B 5/1683
9,554,615 B2 * 1/2017 Labonte ..... A43B 5/16
9,656,153 B2 * 5/2017 Van Horne ..... A63C 17/18
2001/0042324 A1 11/2001 Filice
2002/0029494 A1 * 3/2002 Small ..... A43B 3/0078 36/54
2002/0053147 A1 * 5/2002 Borsoi ..... A43B 5/0401 36/54
2002/0153704 A1 10/2002 Okajima et al.
2003/0014882 A1 1/2003 Bettiol
2004/0016150 A1 1/2004 Labonte et al.
2004/0111918 A1 6/2004 Van Noy et al.
2004/0187351 A1 9/2004 Jones et al.
2005/0126046 A1 6/2005 Labonte et al.
2005/0183288 A1 * 8/2005 Hull ..... A43B 3/0078 36/54
2005/0204585 A1 9/2005 Loveridge et al.
2005/0217146 A1 10/2005 Jones et al.
2005/0223598 A1 10/2005 Jones et al.
2006/0032029 A1 * 2/2006 Nessel ..... B60R 13/0206 24/289
2006/0051566 A1 3/2006 Challe
2006/0277785 A1 12/2006 Vattes et al.
2007/0151123 A1 * 7/2007 Cavasin ..... A43B 1/0018 36/10
2008/0127519 A1 6/2008 Byrne et al.
2008/0172906 A1 7/2008 Jou et al.
2009/0071041 A1 3/2009 Hooper
2009/0277045 A1 * 11/2009 Sartor ..... A43B 5/0458 36/117.2
2010/0132237 A1 * 6/2010 McDermott ..... G09F 3/005 40/633
2010/0156058 A1 6/2010 Koyess et al.
2011/0126431 A1 6/2011 Mazzarolo
2012/0025478 A1 2/2012 Van Horne et al.
2012/0124863 A1 5/2012 Aveni et al.

(56) References Cited

U.S. PATENT DOCUMENTS

| | | | | |
|---|---|---|---|---|
| 2013/0214499 | A1 | 8/2013 | Koyess et al. | |
| 2014/0259794 | A1* | 9/2014 | Labonte | A43B 5/1683 36/115 |
| 2019/0142112 | A1* | 5/2019 | Ramsay | A43B 23/26 |

* cited by examiner

SKATE WITH REMOVABLE TONGUE

TECHNICAL FIELD

The application relates generally to skates and, more particularly, to a tongue for skates.

BACKGROUND OF THE ART

The tongue of a skate can be stitched or otherwise permanently connected to a toe cap of the skate. The tongue can also be removably connected to the toe cap, however, current methods of removable connections may be unsatisfactory due to their complexity and/or insufficient reliability.

SUMMARY

In one aspect, there is provided a skate, comprising: a boot to enclose a foot of a wearer, the boot including a toe portion to cover toes of the wearer, the toe portion having a body with an inner surface facing toward the toes of the wearer when the skate is worn by the wearer, and an exposed outer surface, the toe portion having a toe portion connector on at least one of the inner and outer surfaces; a tongue engageable to the boot and extending along a longitudinal axis between an upper end and a lower end, the tongue at the lower end having a pressing member with cooperating first and second segments, at least one of the first and second segments being foldable to close a gap between the first and second segments, the tongue having a tongue connector on at least one of the first and second segments, the at least one of the first and second segments being foldable to engage the first segment with the inner surface of the toe portion and the second segment with the outer surface of the toe portion, and to engage the tongue connector with the toe portion connector to removably connect the tongue to the toe portion; and a ground-engaging element connected to a bottom of the boot.

In another aspect, there is provided a tongue removably mountable within a boot of a skate, comprising: a body extending along a longitudinal axis between an upper end and a lower end, the body at the lower end having a pressing member with a first segment and a second segment, at least one of the first and second segments being foldable to a position where the first and second segments overlap so as to be able to position a toe portion of the boot between the first and second segments, the body having a tongue connector on at least one of the first and second segments to engage the toe portion and removably connect the tongue to the toe portion.

In a further aspect, there is provided a method of connecting a tongue to a toe portion of a skate, the method comprising: positioning an inner surface of the toe portion against a first segment of a lower end of the tongue, and positioning an outer surface of the toe portion against a second segment of the lower end of the tongue; and removably connecting at least one of the first and second segments of the tongue to at least one of the inner and outer surfaces of the toe portion.

DESCRIPTION OF THE DRAWINGS

Reference is now made to the accompanying figures in which.

DETAILED DESCRIPTION

Figure 1:
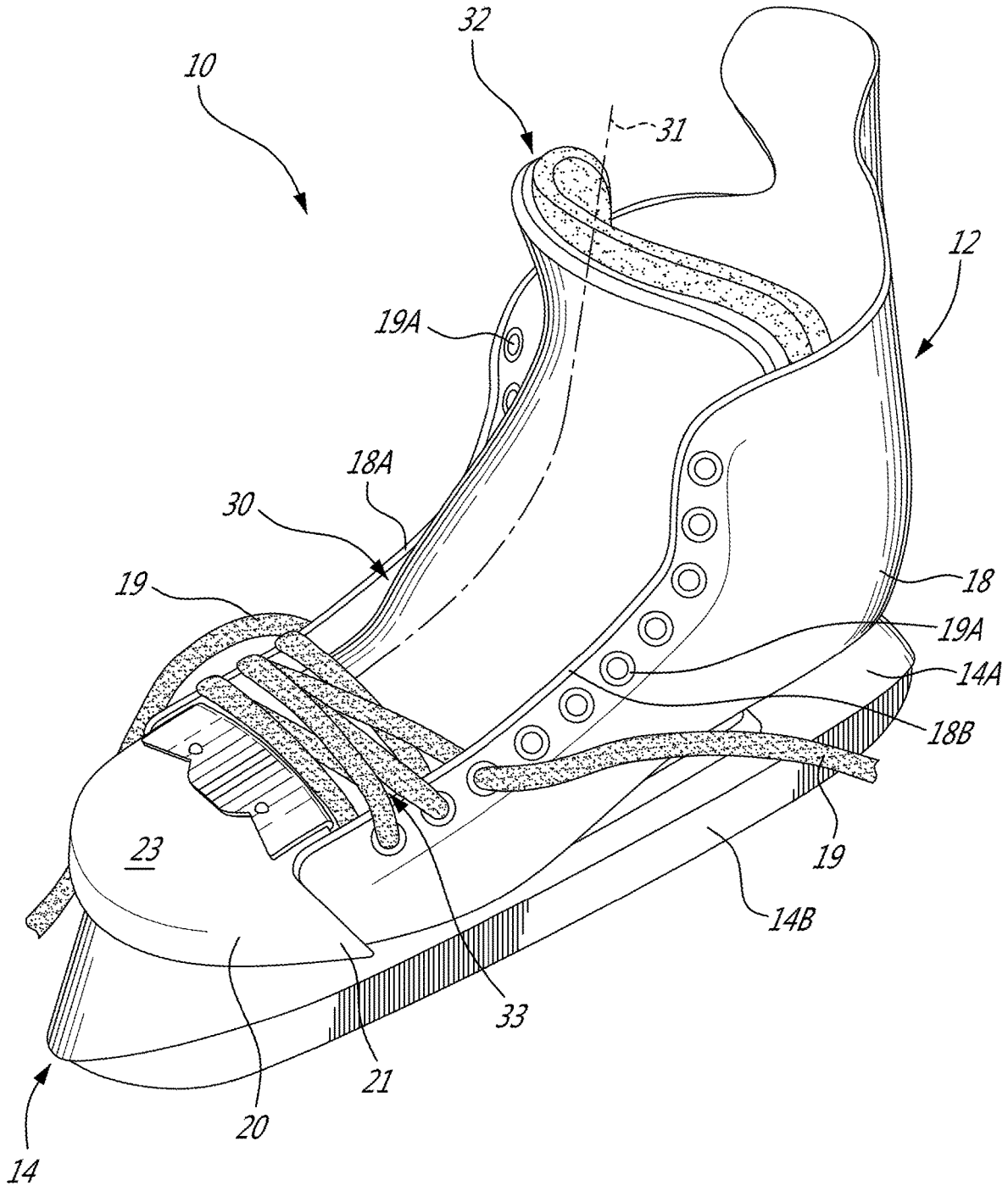
FIG. 1 is a schematic perspective view of a skate, in accordance with a particular embodiment of the present disclosure.

FIG. 1 illustrates a skate 10 in accordance with a particular embodiment. The skate 10 has a skate boot 12 and a ground-engaging element 14 connected to the bottom of the boot 12. In FIG. 1, the ground-engaging element 14 includes a blade holder 14A mounted to the bottom of the boot 12 and a blade 14B that is disposed in the blade holder 14A. The boot 12 includes a shell 18 shaped to enclose the heel, the upper and lower parts of the Achilles tendon, and the medial and lateral surfaces of the foot of a wearer of the skate 10. The boot 12 also includes a toe portion 20, shown here as a toe cap connected to the boot shell 18; alternately, the toe portion 20 can have any other suitable configuration, including, but not limited to, a toe portion integrally formed with the remainder of the boot 12 (e.g., monocoque construction). The skate 10 further includes a tongue 30. The skate 10 is an ice skate in FIG. 1, however it is contemplated that in other embodiments the skate 10 may be for other type of skating activities and have different types of ground-engaging elements 14. For example, in an embodiment, the skate 10 is a roller skate having a wheel holder and a set of wheels as the ground-engaging element 14.

The toe portion 20 has a body 21 that forms the corpus of the toe portion 20 and provides structure thereto. In a particular embodiment where the toe portion 20 is defined as a toe cap, the body 21 may include, for example, a shell of protective material, e.g. a rigid plastic; in a particular embodiment where the toe portion 20 is integrally defined with the remainder of the boot 12, the toe portion 20 may be defined, for example, by a shell of multiple laminated layers of material. The body 21 has an inner surface 22 (see FIG. 2) which faces towards the foot of the wearer when the skate 10 is worn. The body 21 of the toe portion 20 also has an exposed and visible outer surface 23.

The tongue 30 is adapted to fit between sides 18A and 18B of the boot shell 18. The tongue 30 is thus located in part within the boot shell 18, such that the tongue 30 covers the forefoot and the front ankle portion of the foot of the wearer. The tongue 30 is elongated, and extends along a longitudinal axis 31 between an upper end 32 and a lower end 33. The upper end 32 is positioned closer to the shin of the wearer when the skate 10 is worn, and the lower end 33 is positioned adjacent to the toes. The boot 12 includes a lace 19 that extends through lace eyelets 19A in the sides 18A, 18B of the boot shell 18 in a criss-crossing pattern. As such, when the lace 19 is tightened, the lace 19 acts to keep the tongue 30 in place against the wearer's foot.

Figure 2:
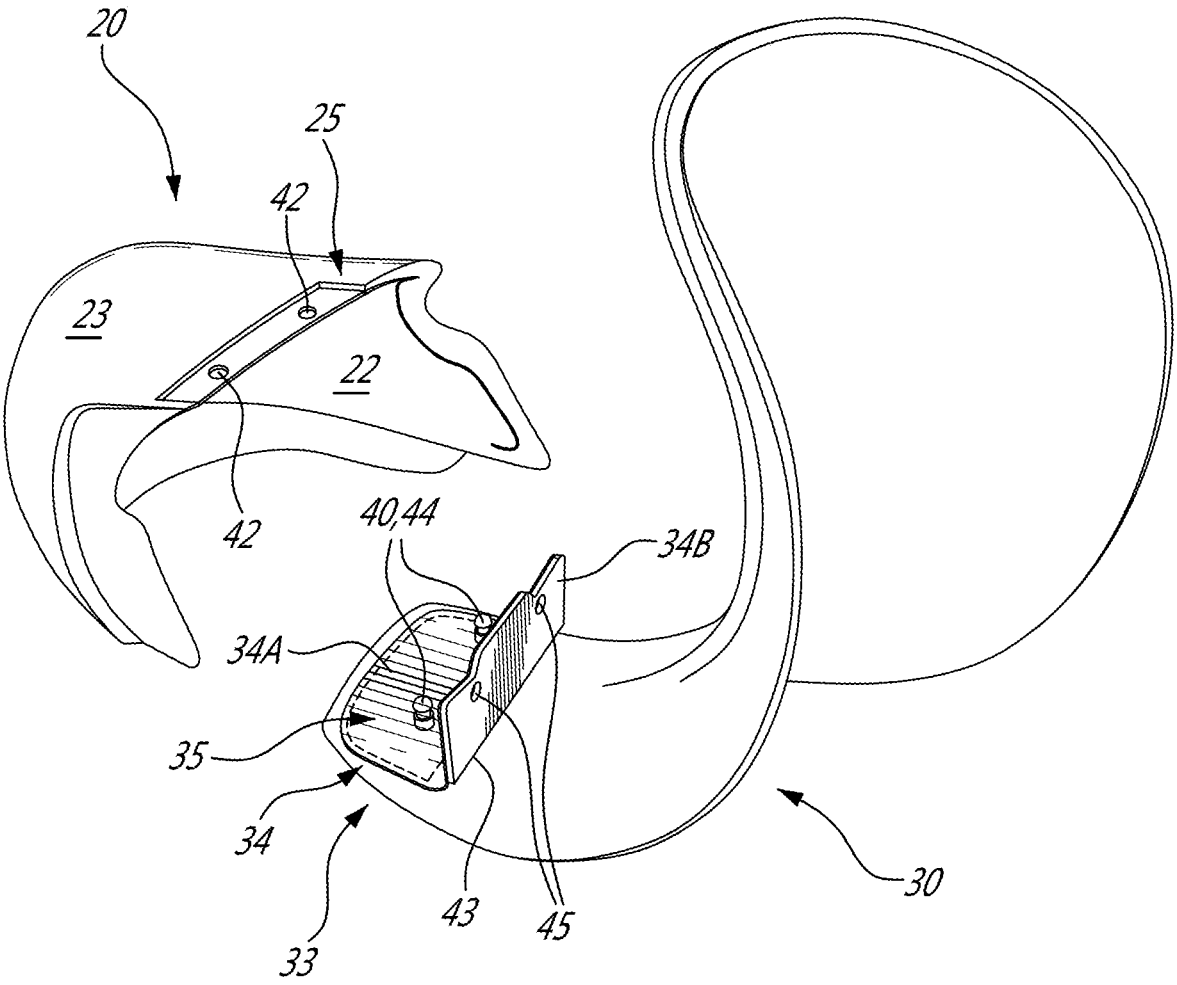
FIG. 2 is a schematic exploded view of a tongue and a toe portion of the skate of FIG. 1.

Referring to FIG. 2, the tongue 30 at the lower end 33 has a pressing member 34. The pressing member 34 is manipulated by the wearer to connect the tongue 30 to the toe portion 20, and to disconnect the tongue 30 from the toe portion 20. The pressing member 34 has a first segment 34A and a second segment 34B. The first and second segments 34A,34B cooperate together (e.g., are able to overlap) to position the toe portion 20 between the first and second segments 34A,34B. One or both of the first and second segments 34A,34B are foldable about a fold line 43 to close a gap between the first and second segments 34A,34B. Stated differently, one or both of the first and second segments 34A,34B are foldable toward the other of the first and second segments 34A,34B in a "clamp" or "sandwiching" motion. The first and second segments 34A,34B of the pressing member 34 therefore press, clamp, or sandwich the toe portion 20 between first and second segments 34A,34B. More particularly, when the tongue 30 is connected to the toe portion 20, the first segment 34A engages the inner surface 22 of the toe portion 20, and the second segment 34B engages the outer surface 23 of the toe portion 20. This engagement can take different forms, as described below.

The first and second segments 34A,34B can assume any configuration suitable for performing the above-described functionality. In the depicted embodiment, the first segment 34A is attached to the external surface of the tongue 30, and the second segment 34B is joined to the first segment 34A at the fold line 43. Only the second segment 34B is foldable in the depicted embodiment. The first and second segments 34A,34B are each flaps of material which are interconnected along the common fold line 43. In another embodiment, each of the first and second segments 34A,34B are clamp arms, where at least one of the clamp arms moves towards the other clamp arm. In yet another embodiment, each of the first and second segments 34A,34B are rigid wedges, where at least one of the wedges moves towards the other wedge. Other configurations for the first and second segments 34A,34B of the pressing member 34 are possible.

As mentioned above, the tongue 30 is removably connected to the toe portion 20 so as to connect the tongue 30 to the boot 12 of the skate 10. As will be described in greater detail below, each of the tongue 30 and the toe portion 20 have components which cooperate to connect the tongue 30 to the toe portion 20, and to disconnect the tongue 30 from the toe portion 20 so that the tongue 30 can be removed. Still referring to FIG. 2, the toe portion 20 has a toe portion connector 25 on one or both of the inner and outer surfaces 22,23 of the toe portion 20. The tongue 30 has a tongue connector 35 on at least one of the first and second segments 34A,34B of the pressing member 34. The tongue connector 35 and the toe portion connector 25 and/or components thereof are complementary because they cooperate together to removably connect the tongue 30 to the toe portion 20. The tongue connector 35 and toe portion connector 25 therefore have components which are compatible with one another. When one or both of the first and second segments 34A,34B are folded to close the gap between them, the tongue connector 35 is brought into engagement with the toe portion connector 25, and the tongue 30 is removably connected to the toe portion 20. Different non-limitative embodiments of the tongue connector 35 and the toe portion connector 25 which achieve this functionality are now described in greater detail.

Still referring to FIG. 2, the tongue connector 35 includes two mating tab 40 disposed on the first segment 34A of the pressing member 34, and the toe portion connector 25 includes two apertures 42 extending through the inner and outer surfaces 22,23 of the toe portion 20. In FIG. 2, the outer surface 23 of the toe portion 20 has a portion that is recessed from a remainder of the outer surface. One or both of the apertures 42 extends through the inner and outer surfaces 22,23 at the recessed portion of the outer surface 23. In the depicted embodiment, each mating tab 40 is defined as a press-fit pin 44 each being insertable through a corresponding aperture 42. The tongue connector 35 also includes two segment apertures 45 extending through the second segment 34B of the pressing member 34, and the second segment 34B is foldable about the fold line 43 so that the pins 44 are receivable in the segment apertures 45. In an alternate embodiment, the configuration of the components of the tongue and toe portion connectors 35,25 is reversed, in that the press-fit pins 44 are disposed on the outer surface 23 of the toe portion 20, and the two apertures 42 extend through the first segment 34A of the pressing member 34. Moreover, it is understood that a single mating tab and aperture, or more than two mating tabs and apertures could be provided.

Figure 3A:
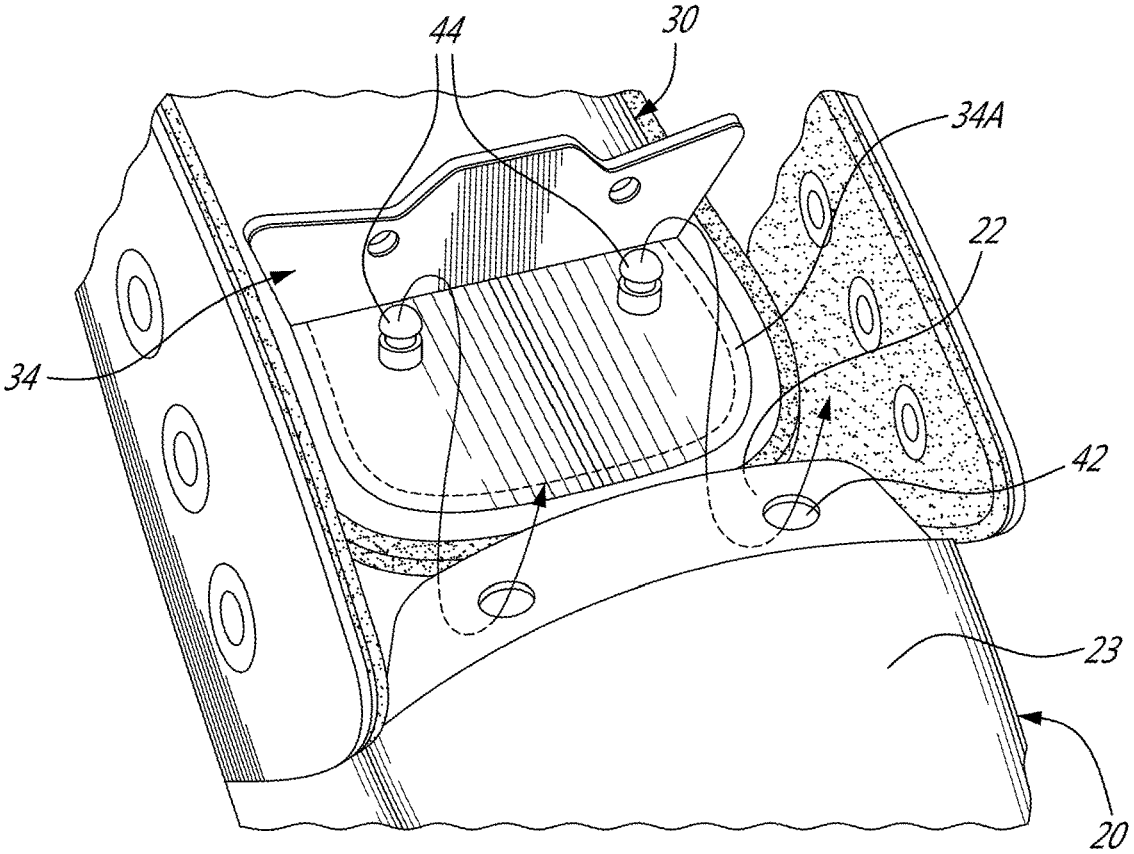
FIG. 3A is a schematic perspective view of a tongue connector of the tongue and a toe portion connector of the toe portion of FIG. 2.
Figure 3B:
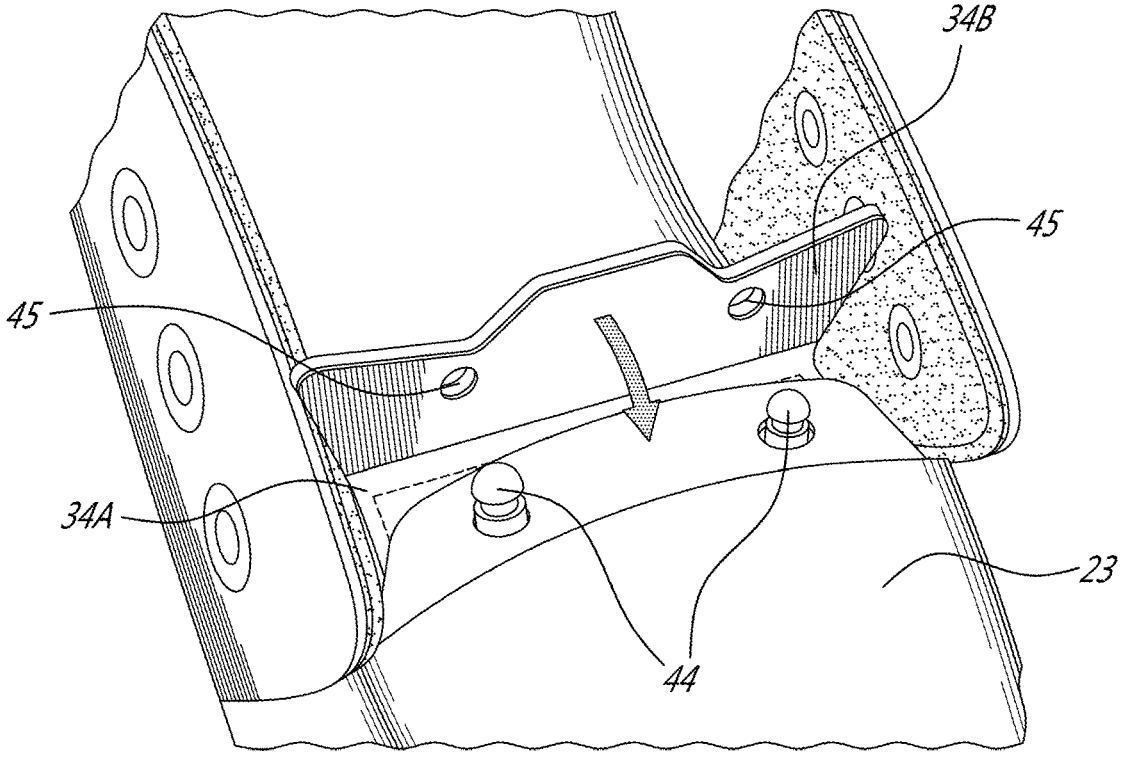
FIG. 3B is a schematic perspective of the tongue connector and toe portion connector of FIG. 3A partially engaged with each other.
Figure 3C:
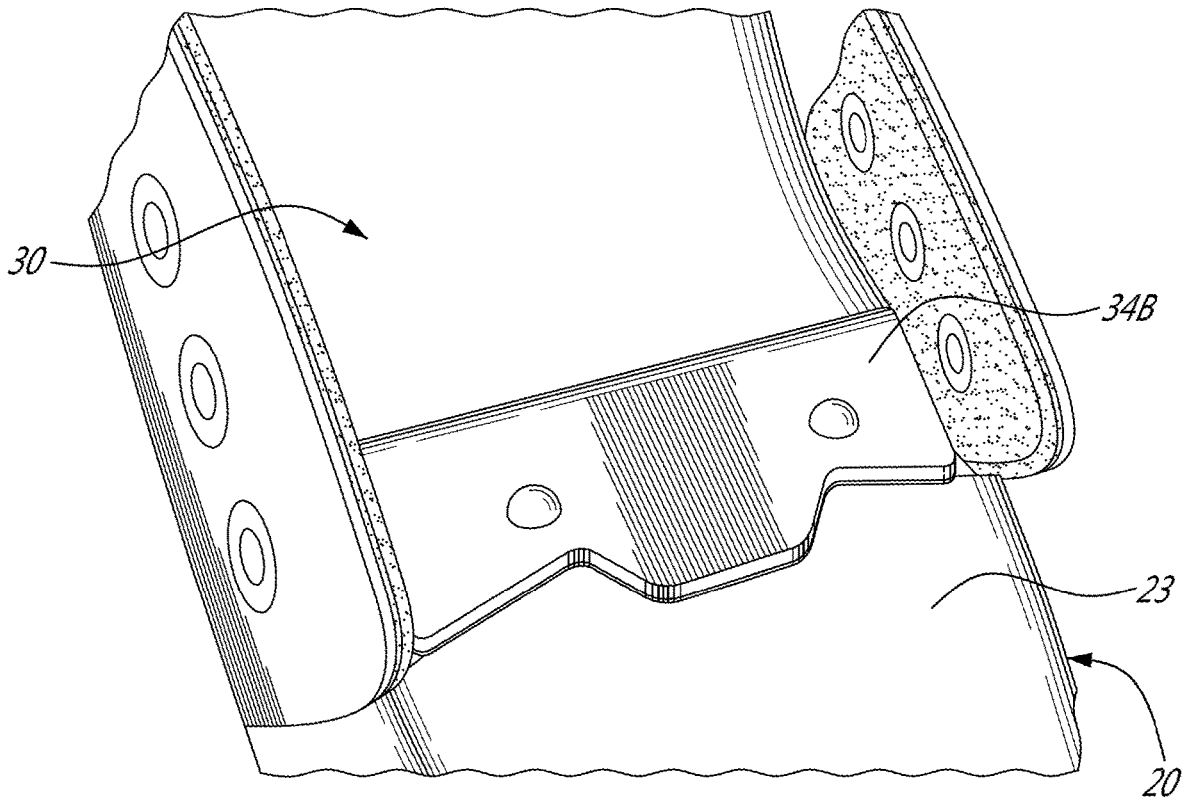
FIG. 3C is a schematic perspective of the tongue connector and toe portion connector of FIG. 3A engaged to each other so that the tongue is removably connected to the toe portion.

Referring to FIGS. 3A to 3C, in use and in a particular embodiment, the tongue 30 is connected to the toe portion 20 by positioning the inner surface 22 of the toe portion 20 against the first segment 34A at the lower end 33 of the tongue 30, and positioning the outer surface 23 of the toe portion 20 against the second segment 34B. One or both of the first and second segments 34A,34B is removably connected to one or both of the inner and outer surfaces 22,23. For example, the first segment 34A of the pressing member 34 is placed against the inner surface 22 of the toe portion 20, and the press-fit pins 44 are inserted through the apertures 42 in the two cap 20, as shown in FIG. 3A. The second segment 34B of the pressing member 34 is folded towards the first segment 34A to engage the second segment 34B with the outer surface 23 of the toe portion 20, and to insert the press-fit 44 pins through the segment apertures 45, as shown in FIG. 3B. The inner and outer surfaces 22,23 of the toe portion 20 are therefore sandwiched between the first and second segments 34A,34B of the tongue 30, and the tongue 30 is removably connected to the toe portion 20, as shown in FIG. 3C. The press-fit pins 44, the apertures 42 and the segment apertures 45 are proportionately dimensioned to form a frictional engagement between the pins 44 and the apertures 42 and/or between the pins 44 and the segment apertures 45. The press-fit pins 44 may therefore frictionally engage the toe portion 20 via the apertures 42, and/or the tongue 30 (more specifically, the second segment 34B on the tongue 30) via the segment apertures 45.

Figure 4A:
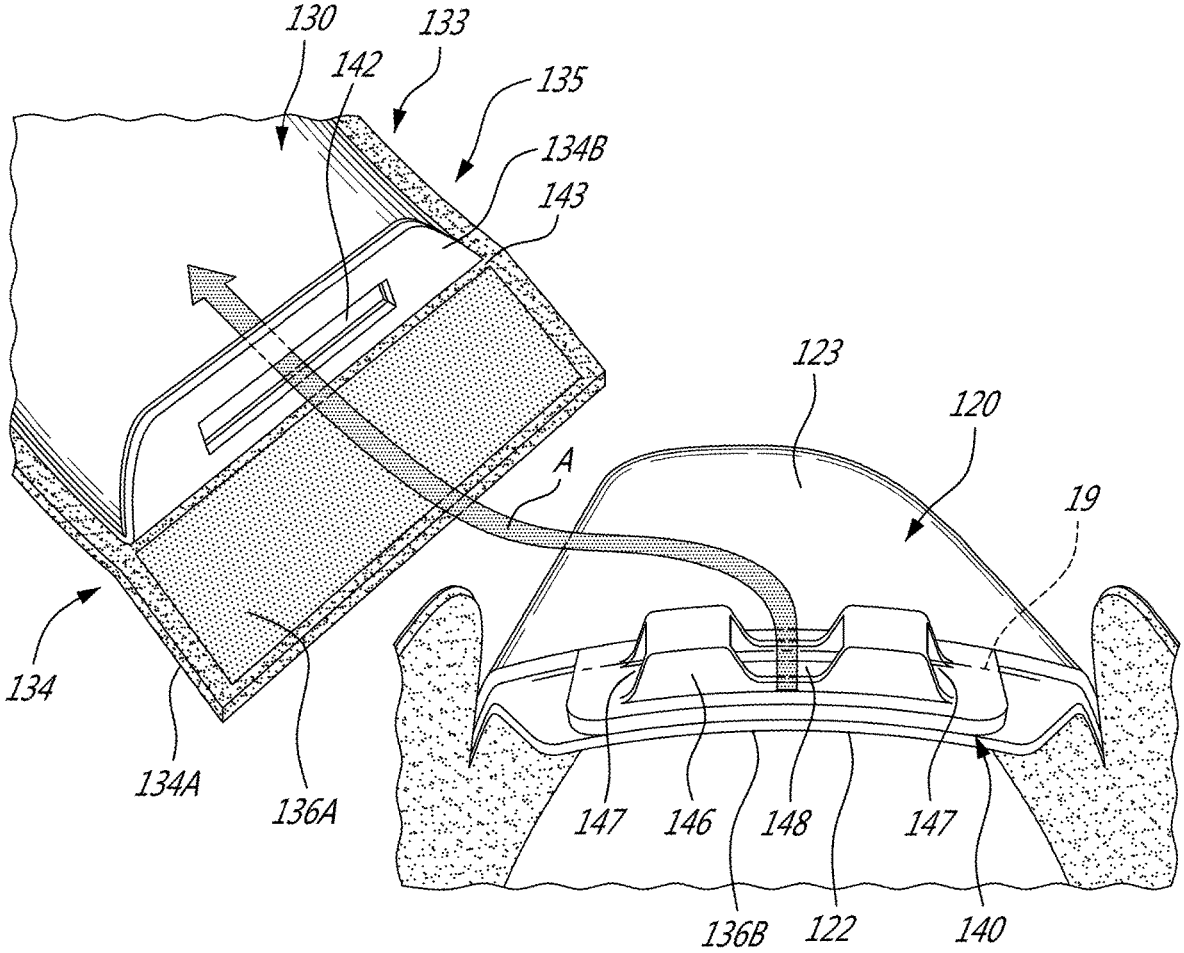
FIG. 4A is an exploded view of a tongue and a toe portion of a skate according to another embodiment of the present disclosure.
Figure 4B:
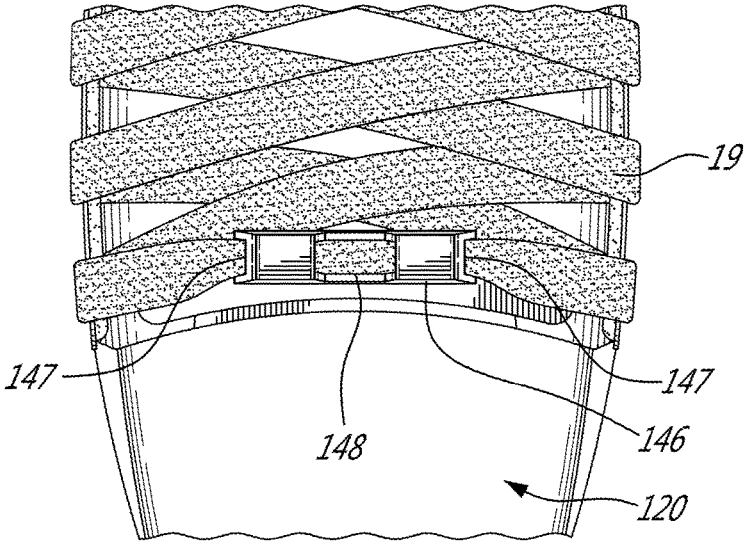
FIG. 4B is a perspective view of the tongue and the toe portion of FIG. 4A being removably connected.

Another embodiment of the tongue 130 and the toe portion 120 is shown in FIGS. 4A-4B. Referring to FIG. 4A, the tongue connector 135 includes an aperture 142 which extends through the second segment 134B of the pressing member 134, and the toe portion connector 125 includes a mating tab 140 extending outwardly from the outer surface 123 of the toe portion 120. The mating tab 140 is adapted to pass through (see arrow "A" in FIG. 4A) and fit in the aperture 142 defined within tongue 130 to removably connect the tongue 130 to the toe portion 120. In the depicted embodiment, the first and second segments 134A,134B both extend from the body of the tongue 130, so that the lower end 133 of the tongue 130 is "split" into the first and second segments 134A,134B. Both the first and second segments 134A,134B are foldable about the fold line 143 toward each other.

The mating tab 140 includes a lace bracket 146 for receiving the lace 19 of the skate. The lace bracket 146 has two lace apertures 147 extending through the lace bracket 146 to receive the lace 19 therethrough. The lace bracket 146 has a lace window 148 through which the wearer can see the lace 19 pass through the lace bracket 146.

Still referring to FIG. 4A, the tongue connector 135 also includes a hook-and-loop fastener 136A disposed on the first segment 134A of the pressing member 134. The toe portion connector 125 includes a complementary hook-and-loop fastener 136B disposed on the inner surface 122 of the toe portion 120. Both the first and second segments 134A,134B of the pressing member 134 of FIG. 4A are foldable toward one another to engage the hook-and-loop fasteners 136A, 136B together and to insert the lace bracket 146 through the aperture 142 in the second segment 134B. In an alternate embodiment, the configuration of the components of the tongue and toe portion connectors 135,125 is reversed, in that the lace bracket 146 is disposed on the first segment 134A of the pressing member 134, and the aperture 142 extends through the toe portion 120. The complementary hook-and-loop fasteners could also be provided on other mating surfaces of the tongue 130 and toe portion 120.

Referring to FIGS. 4A and 4B, in order to connect the tongue 130 to the toe portion 120, the first segment 134A of the pressing member 134 is placed against the inner surface 122 of the toe portion 120, and the hook-and-loop fasteners 136A,136B are engaged together. The lace bracket 146 is also inserted through the aperture 142 in the second segment 134B by folding the second segment 134B toward the first segment 134A. The tongue 130 is now partially connected to the toe portion 120 because the hook-and-loop fasteners 136A,136B are engaged. In order to fully connect the tongue 130 to the toe portion 120, the lace 19 is inserted first through one of the lace apertures 147, past the lace window 148, and then through the other lace aperture 147, as shown in FIG. 4B. When the lace 19 is inserted through the lace bracket 146, the second segment 134B and its aperture 142 are prevented from being removed from the lace bracket 146. In a particular embodiment, the lace bracket 146 is loosely received through the aperture 142, so that the lace 19 inserted through the lace bracket 146 outside of the toe portion 120 prevents the second segment 134B from being disengaged from the lace bracket 146 and serves as a locking mechanism that removably connects the tongue 130 to the toe portion 120. Alternately, the lace bracket 146 may be received in the aperture 142 with a press fit.

The tongue connector 35,135 and the toe portion connector 25,125 are not limited to the configurations described above. Any complementary mechanical fastening or mating of male-female components can be used to connect the tongue connector 35,135 to the toe portion connector 25,125. Similarly, the mating tab 40,140 described herein is not limited to including only the press-fit pins 44 and lace bracket 146, and can include other male connectors. The components of the mating tab 40,140 may be fabricated from any suitable material, including, but not limited to, an injected plastic material or rubber. Only a single segment may be provided on the tongue, i.e. one of the first and second segments 34A,34B, 134A,134B may be omitted.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A skate, comprising:

a boot to enclose a foot of a wearer, the boot including a toe portion to cover toes of the wearer, the toe portion having an inner surface facing toward the toes of the wearer when the skate is worn by the wearer, and an exposed outer surface, the toe portion having a toe portion connector including two toe portion apertures spaced apart from each other and extending through the inner and outer surfaces;

a tongue engageable to the boot and extending along a longitudinal axis between an upper end and a lower end, the lower end of the tongue having a pressing member with cooperating first and second segments, at least one of the first and second segments being displaceable toward the other of the first and second segments to removably connect the tongue to the boot, the pressing member having a tongue connector including two mating tabs spaced apart from each other and disposed on the first segment and two segment apertures spaced apart from each other and extending through the second segment;

in a sandwiched position the first segment engages the inner surface of the toe portion and the second segment engages the outer surface of the toe portion, the two toe portion apertures align with the two segment apertures, and the two mating tabs of the tongue connector pass into the two toe portion apertures of the toe portion connector and into the two segment apertures; and a ground-engaging element connected to a bottom of the boot.

2. The skate as defined in claim 1, wherein the two mating tabs each include a press-fit pin and the two segment apertures are each complementarily shaped to receive the press-fit pin in frictional engagement.

3. The skate as defined in claim 1, wherein the toe portion extends between a trailing edge and a front end, the connection portion recessed from a remainder of the outer surface.

4. The skate as defined in claim 3, wherein the two toe portions apertures extend through the inner and outer surfaces at the recessed connection portion.

5. The skate as defined in claim 3, wherein at least one of the first and second segments is foldable between the sandwiched position and an open position to close a gap between the first and second segments and removably connect the tongue to the toe portion.

6. The skate as defined in claim 5, wherein the second segment covers the recessed connection portion in the folded position.

7. The skate as defined in claim 5, wherein the at least one of the first and second segments is foldable about a fold line, the trailing edge of the toe portion being immediately adjacent to the fold line in the folded position.

8. The skate as defined in claim 3, wherein the recessed connection portion is closer to the trailing edge of the toe portion than to the front end.

* * * * *